US008012405B2

(12) United States Patent
Kendall

(10) Patent No.: US 8,012,405 B2
(45) Date of Patent: Sep. 6, 2011

(54) REGULATION METHOD FOR MELT THROUGHFLOW THROUGH A MELT THROUGHFLOW APERTURE

(75) Inventor: Martin Kendall, Hasselt (BE)

(73) Assignee: Heraeus Electro-Nite International N.V., Houthalen (BE)

( * ) Notice: Subject to any disclaimer, the term of this patent is extended or adjusted under 35 U.S.C. 154(b) by 0 days.

(21) Appl. No.: 12/712,510

(22) Filed: Feb. 25, 2010

(65) Prior Publication Data

US 2010/0147904 A1 Jun. 17, 2010

Related U.S. Application Data

(63) Continuation of application No. 11/286,508, filed on Nov. 23, 2005.

(30) Foreign Application Priority Data

Nov. 26, 2004 (DE) ..... 10 2004 057 381

(51) Int. Cl.
*C21B 7/12* (2006.01)

(52) U.S. Cl. ..... 266/45; 266/78

(58) Field of Classification Search ..... 266/236, 266/78, 45; 222/593, 603
See application file for complete search history.

(56) References Cited

U.S. PATENT DOCUMENTS

| | | | | |
|---|---|---|---|---|
| 4,792,070 | A | 12/1988 | Daussan et al. | |
| 5,028,033 | A | 7/1991 | Morioka et al. | |
| 6,660,220 | B2 | 12/2003 | Forman | |
| 2003/0116893 | A1 | 6/2003 | Forman | |
| 2006/0113059 | A1 * | 6/2006 | Kendall | 164/453 |

FOREIGN PATENT DOCUMENTS

| | | | |
|---|---|---|---|
| EP | 0446406 | A1 | 9/1991 |
| JP | 58061954 | A | 4/1983 |
| JP | 59133955 | A | 8/1984 |
| JP | 61003653 | A | 1/1986 |
| JP | 61206559 | A | 9/1986 |
| JP | 2187239 | A | 7/1990 |
| JP | 3193250 | A | 8/1991 |
| JP | 4270042 | A | 9/1992 |
| JP | 7290422 | A | 11/1995 |

(Continued)

OTHER PUBLICATIONS

Office Action Issued Aug. 11, 2008 in U.S. Appl. No. 11/286,508.

(Continued)

*Primary Examiner* — Scott Kastler
(74) *Attorney, Agent, or Firm* — Panitch Schwarze Belisario & Nadel LLP

(57) ABSTRACT

A method for regulating metal melt throughflow through a melt throughflow aperture in a bottom nozzle of a metallurgical vessel is provided. The bottom nozzle has an upper nozzle arranged in a floor of the metallurgical vessel and a lower nozzle arranged below the upper nozzle. The method includes introducing inert gas through at least one inert gas inlet aperture into the melt throughflow aperture in the bottom nozzle, arranging a temperature sensor on or in the lower nozzle for determining a temperature in a wall of the bottom nozzle, and regulating an inert gas supply into the bottom nozzle using measurement signals from the sensor. A decrease in the temperature signals an increase of metal clogging and an increase in the temperature signals a decrease of metal clogging.

10 Claims, 3 Drawing Sheets

FOREIGN PATENT DOCUMENTS

| | | | |
|---|---|---|---|
| JP | 8290250 | A | 11/1996 |
| JP | 11104814 | A | 4/1999 |
| JP | 11170033 | A | 6/1999 |
| JP | 2002143994 | A | 5/2002 |
| JP | 2002210545 | A | 7/2002 |
| JP | 2004243407 | A | 9/2004 |
| KR | 1020030017154 | | 3/2003 |
| KR | 1020030054769 | | 7/2003 |
| KR | 100817146 | B1 | 3/2008 |
| WO | 0156725 | | 8/2001 |
| WO | 2004035249 | A1 | 4/2004 |

OTHER PUBLICATIONS

Office Action Issued Jul. 8, 2005 in DE Application No. 10 2004 057 381.6-24.
European Search Report dated Aug. 24, 2006 in EP Application No. 05024382.
OA Issued Dec. 11, 2006 in AU Application No. 2005234658.
Office Action issued Nov. 1, 2010 from the U.S. Patent and Trademark Office in related U.S. Appl. No. 11/286,508.
Office Action issued Apr. 15, 2011 in KR Application No. 10-2005-0113826 (with English translation).

* cited by examiner

REGULATION METHOD FOR MELT THROUGHFLOW THROUGH A MELT THROUGHFLOW APERTURE

CROSS-REFERENCE TO RELATED APPLICATIONS

This application is a continuation of co-pending U.S. patent application Ser. No. 11/286,508, filed Nov. 23, 2005, the disclosure of which is incorporated herein by reference.

BACKGROUND OF THE INVENTION

The invention relates to a method for regulating the throughflow through a bottom nozzle of a metallurgical vessel. Furthermore, the invention relates to a bottom nozzle of a metallurgical vessel.

In particular, in steel melting the liquid metal is cast from a distributor, for example in a continuous casting plant. It flows through a bottom nozzle arranged in the floor of the distributor housing. Adherence of material to the wall of the bottom nozzle during throughflow is disadvantageous. The cross section of the aperture is thereby decreased, so that the flow properties are disadvantageously affected. To prevent the adherence of material to the wall, an inert gas, such as argon, is often introduced into the throughflow aperture. However, excessive amounts of gas negatively affect the steel quality, for example by the formation of cavities in the steel which lead to surface defects when the steel is rolled.

A material for a bottom nozzle is described, for example, in International patent application Publication No. WO 2004/035249 A1. A bottom nozzle within a metallurgical vessel is disclosed in Korean published patent application No. KR 10 2003-0017154 A or in U.S. published patent application Ser. No. 2003/0116893 A1. In the latter publication, the use of inert gas is shown, with the aim of reducing the adherence of material to the inner wall of the bottom nozzle (so-called clogging); this is similarly described in Japanese published patent application (Kokai) No. JP 2-187239. A mechanism with a gas supply regulation is known in detail from International patent application Publication No. WO 01/56725 A1. Nitrogen is supplied according to the Japanese Kokai No. JP 8-290250. Japanese Kokai No. JP 3-193250 discloses a method for observing the adherence or clogging of material with the aid of numerous temperature sensors arranged one behind the other along the bottom nozzle. The introduction of inert gas into the interior of the bottom nozzle is further known from, among others, Japanese Kokai Nos. JP 2002-210545, JP 61-206559, JP 58-061954, and JP 7-290422. It is furthermore known from a few of these publications, in addition to the introduction of inert gas, to prevent the access of oxygen as far as possible by using housings around a portion of the bottom nozzle. An excess pressure of inert gas is partially produced within such a housing, as disclosed, for example, in JP 8-290250.

A housing around a valve of the bottom nozzle, to prevent the entry of oxygen, is disclosed in Japanese Kokai JP 11-170033. The throughflow of the metal melt through the bottom nozzle is controlled by sliding gates, according to the above-mentioned publications. These sliding gates slide perpendicularly to the throughflow direction of the metal and can thus close the bottom nozzle. Another possibility for throughflow regulation is a so-called plug bar (also termed stopper rod), as known, for example, from Japanese Kokai JP 2002-143994.

In the Korean published patent application No. KR 10 2003-0054769 A, the arrangement of a housing around the valve of a bottom nozzle is described. The gas present in the housing is sucked out by means of a vacuum pump. Japanese Kokai JP 4-270042 describes a similar housing. Here, as in others of the above-mentioned publications, a non-oxidizing atmosphere is produced within the housing. The housing has an aperture through which the inert gas can be supplied. A further arrangement, in which the gas is sucked out of the housing partially surrounding the bottom nozzle, in order to produce a vacuum within the housing, is known from Japanese Kokia JP 61-003653.

BRIEF SUMMARY OF THE INVENTION

The present invention has as its object to further improve the present techniques, in order to minimize the adherence of clogging in the nozzle of a bottom nozzle in a simple and reliable manner, without thereby impairing the quality of the metal melt or of the solidified metal.

According to a method of the invention, the metal melt throughflow is regulated through a bottom nozzle of a metallurgical vessel, with an upper nozzle arranged in the floor of the metallurgical vessel, a lower nozzle arranged below the upper nozzle, at least one inert gas inlet aperture, and a sensor arranged on or in the lower nozzle for determining the layer thickness of the clogging in the nozzle. The inert gas supply into the bottom nozzle is regulated using the measurement signals of the sensor.

In particular, starting from an existing throughflow quantity of the inert gas or an existing pressure of the inert gas, the throughflow quantity and/or the pressure is reduced until the sensor signals an increase of clogging and/or the throughflow quantity and/or the pressure are increased until the sensor signals a decrease or release of the clogging. The inert gas flow can thereby be reduced to a minimum, so that little inert gas is introduced into the metal melt and, consequently, little inert gas is present in the finished metal, for example steel. A temperature sensor arranged on or in the outside of the lower nozzle is preferably used as the sensor. Instead of a temperature sensor, a resistive sensor, an inductive sensor, an ultrasonic detector, or an x-ray detector can also be used for the measurement.

It is advantageous that the throughflow quantity and/or the pressure be reduced until the measured wall temperature falls more rapidly than a predetermined threshold value of cooling and/or that the throughflow quantity and/or the pressure be increased until the measured wall temperature falls less rapidly than a predetermined threshold of cooling. In particular, it can be advantageous that the flow of metal melt be regulated by means of a valve arranged between the upper and the lower nozzle or above the upper nozzle. In the former case, a sliding gate is used between the upper and the lower nozzles; in the latter case, a stopper rod is used. It is also advantageous that the introduction of the inert gas into the throughflow aperture of the bottom nozzle take place below the upper nozzle. Argon is preferably used as the inert gas.

According to the invention, a bottom nozzle for a metallurgical vessel for performing the method has an upper nozzle arranged in the floor of a metallurgical vessel and a lower nozzle arranged below the upper nozzle, at least one inert gas aperture with an inert gas connection being arranged below the upper nozzle, and a sensor, preferably a temperature sensor, being arranged on or in the outside of the lower nozzle for determining the layer thickness of clogging in the nozzle. The sensor is connected with a flow control for the inert gas. At least one of the nozzles can advantageously have a heater. It is reasonable that a valve (sliding gate or stopper rod) be arranged below or above the upper nozzle for regulating the flow of metal melt.

A further bottom nozzle for a metallurgical vessel, according to the invention, has an upper nozzle arranged in the floor of a metallurgical vessel and a lower nozzle arranged below the upper nozzle, and has a wall of the throughflow aperture through the nozzles, the wall being at least sealed against flow of metal melt and the nozzles being at least partially surrounded by a gastight housing, such that the housing encloses the lower end of the lower nozzle at its periphery in a gas-tight manner, wherein the housing abuts on the outside of the nozzle with a portion of its inner side, and that a thermally insulating solid is arranged between the wall of the throughflow aperture and the housing. The term "at least partially" means that of course the nozzles cannot be completely surrounded by the housing, for example at their openings.

The housing prevents the penetration of gas. It has an upper end and a lower end and is gastight between these ends. With this arrangement, the bottom nozzle has two basic seals, namely a melt flow seal in the region of the wall of the throughflow aperture and a gas seal in the colder region of the bottom nozzle remote from the throughflow aperture. Consequently, fewer temperature-resistant materials can be used for achieving gas-tightness. By "gas-tight," absolute gas-tightness is of course not to be understood, but a smaller gas flow is possible, for example less than about 10 ml/s, preferably less than about 1 ml/s, and particularly preferably on the order of about $10^{-4}$ ml/s, depending on the kind and location of the seals/materials. Such a value is smaller by at least an order of magnitude than is known in the prior art. The minimization of clogging is the result of the gas-tightness (especially oxygen tightness).

The housing preferably has plural housing portions, connected together in a gas-tight manner and preferably arranged one above the other, at least one housing portion being connected in a gas-tight manner to the upper nozzle and/or the floor of the metallurgical vessel, preferably abutting with a portion of its side surface on the outside of the upper nozzle and/or of the floor. It is furthermore advantageous that a valve for regulating the metal melt flow be arranged above the upper nozzle, or between the upper and lower nozzles. In the former case, the valve is a stopper rod; in the latter case, it is a sliding gate. Preferably, a permanent getter material, particularly one selected from the group titanium, aluminum, magnesium or zirconium, is arranged within the housing or in the thermally insulating material.

The housing is advantageously formed as at least partially tubular (hollow cylinder) or conical, preferably with an oval or circular cross section.

The housing can advantageously be constructed of steel, and the thermally insulating material can preferably contain aluminum oxide. It can be beneficial that at least one of the nozzles has a heater.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
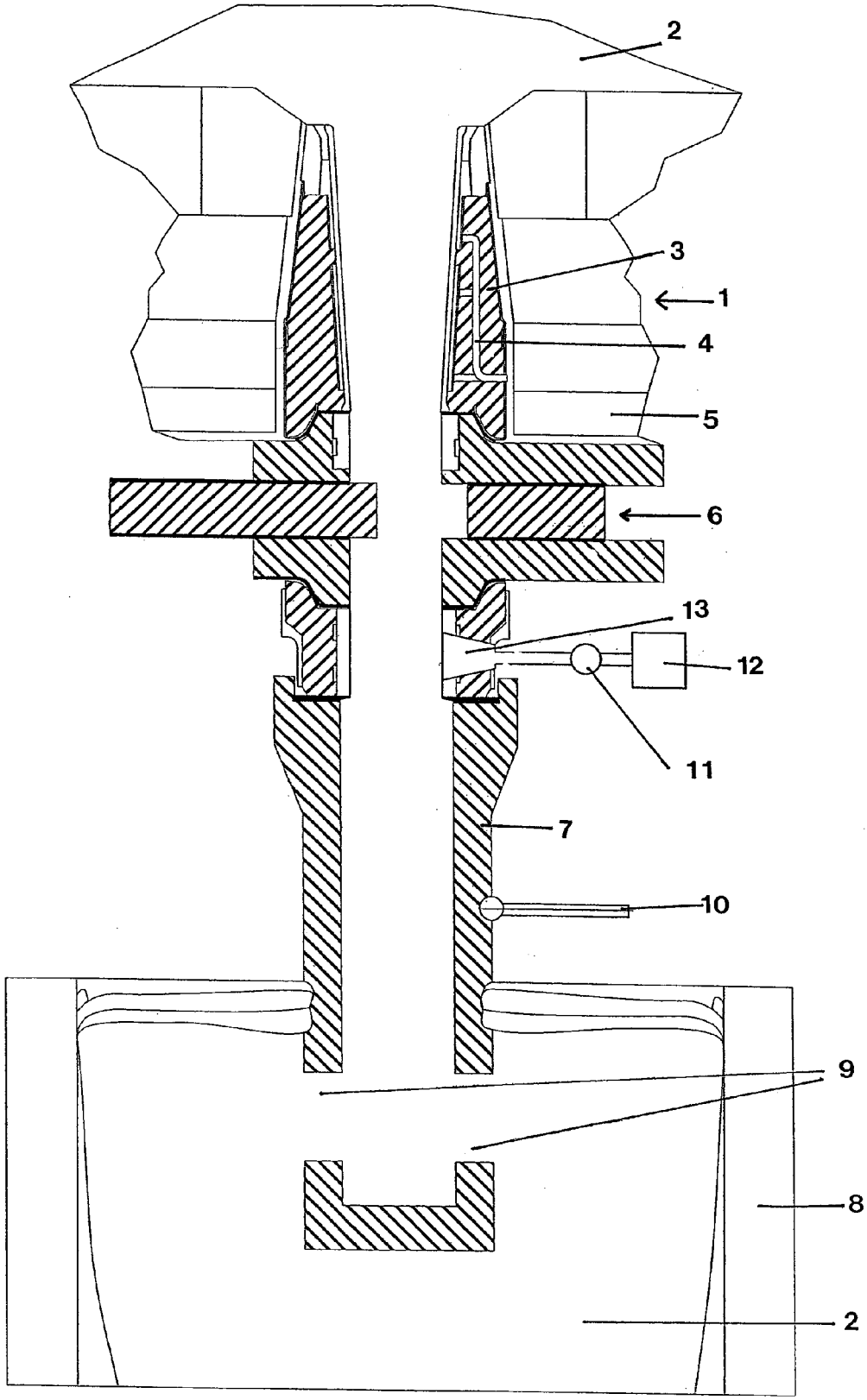
FIG. 1 is a side elevation view, partially in section, of a bottom nozzle for performing the method according to the invention.

The bottom nozzle shown in FIG. 1 in the floor of a distributor for steel melt 2 has an upper nozzle 3 within the floor 1. Electrodes 4 for producing an electrochemical effect or as heaters are arranged in this nozzle 3. The floor 1 itself has different layers of a refractory material and a steel housing 5 on its outside. A sliding gate 6 for regulating the flow of steel melt is arranged below the upper nozzle 3, and below it a lower nozzle 7 which projects into the metal melt container 8, which belongs to a continuous casting plant for the steel, for example. The steel melt 2 flows through apertures 9 into the metal melt container 8. A temperature sensor 10 measures the temperature at the outside of the lower nozzle. When this temperature falls, this indicates an increase of clogging within the lower nozzle 7, since the insulation increases between the outside of the lower nozzle 7 and the steel melt 2 flowing through the nozzle. The temperature sensor 10, together with the pressure sensor 11, effects the regulation of the argon supply through the inert gas aperture 13 to the metal melt 2 via a pressure regulation 12.

Figure 2:
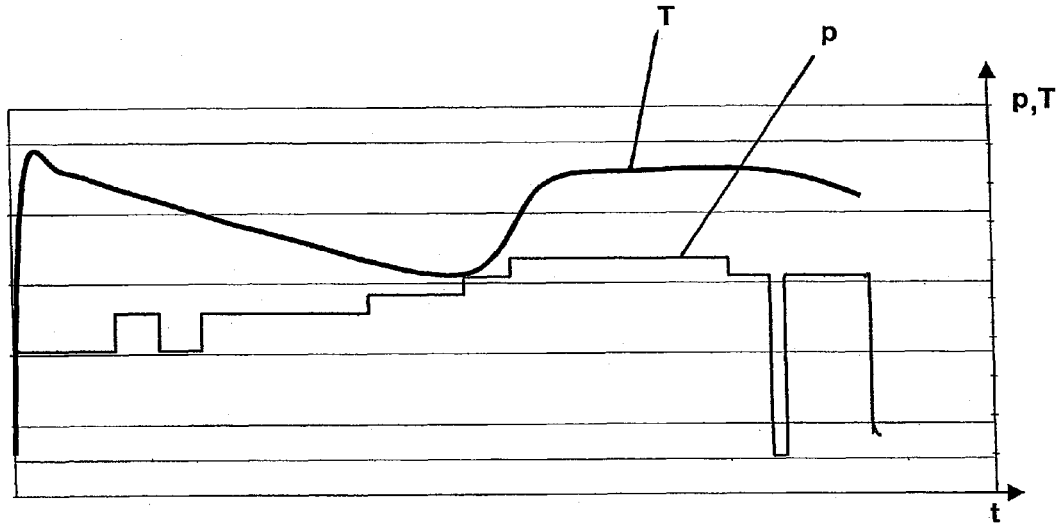
FIG. 2 is a graph plotting temperature and pressure over time for the nozzle and method of the invention.

Pressure and temperature curves over time are shown in FIG. 2. With falling temperature (thick line), the argon pressure is increased stepwise, so that the argon flow into the throughflow aperture causes a release of the clogging on the wall. Thereafter the temperature measured on the outer wall rises again up to a value which remains constant. The argon pressure/argon flow can in this way be set to a minimum at which the formation of clogging is just prevented or kept at a slight level.

Figure 3:
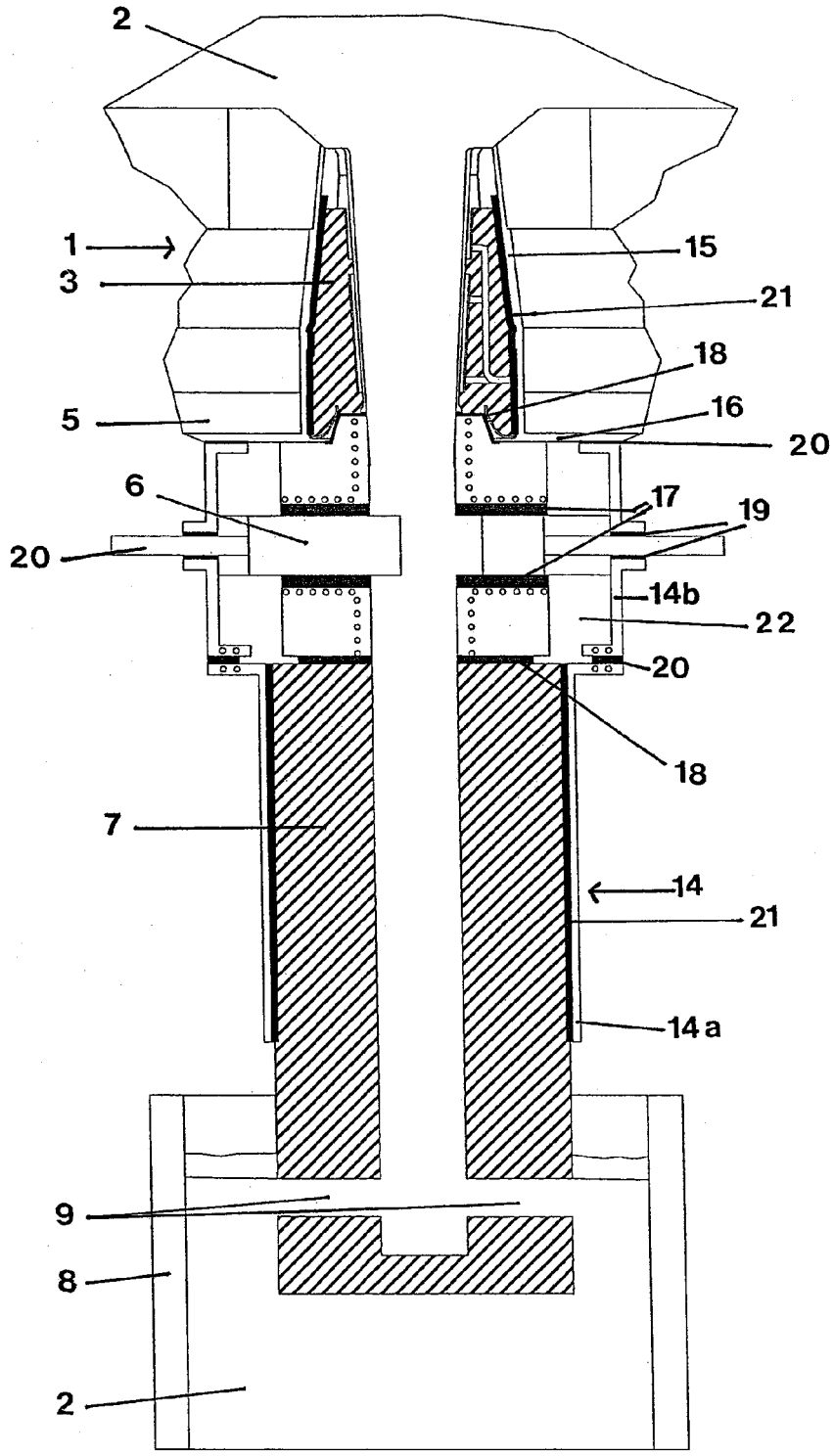
FIG. 3 is a side elevation view, partially in section, similar to FIG. 1, illustrating a bottom nozzle sealed according to the invention.

The bottom nozzle shown in FIG. 3 has an essentially two-part seal, namely a seal which seals against melt flow along the inside of the throughflow aperture and a housing 14, which effects a gas-tight sealing to the outside (between the atmosphere of the environment and the throughflow aperture), the individual seals being arranged in a clearly lower temperature region. The housing 14 comprises plural portions 14*a* and 14*b* and in principle is extended into the metal sleeve 15, which encloses the upper nozzle 3 on its outside and opens into a flange 16, on which a portion of the outer surface of the upper housing portion 14*b* is sealingly arranged. The various seals are shown in FIG. 3.

So-called type 1 seals 17 exist between opposed movable portions on the sliding gate 6. They are at least partially exposed to the metal melt. Type 2 seals 18 are arranged between refractory portions of the bottom nozzle 1, for example between portions of the sliding gate 6 and the upper nozzle 3 or the lower nozzle 7. These type 2 seals 18 are also at least partially directly exposed to the metal melt or to the temperature of the liquid steel. Furthermore, the wall of the throughflow aperture of the bottom nozzle 1 itself represents a seal (type 3 seal), which is influenced by the choice of material. The seals described above are in principle present in all known arrangements. They can, for example, be formed of aluminum oxide. The sealing effect of the type 3 seals can be improved by high temperature glass layers, among other things.

The portions of the outer housing 14 form a type 4 seal, which is not exposed to steel melt or to comparable temperatures. These seals can be formed of metal, for example steel, or from dense sintered ceramic material. Type 5 seals 19 are between portions of the housing 14 and movable portions of the throughflow regulation means, such as the push rods 20 of the sliding gate 6. They are not exposed to liquid steel and, according to the specific temperature conditions, can consist of Inconel (up to 800° C.), of aluminum, copper, or graphite (up to about 450° C.), or of an elastomeric material (at temperatures up to about 200° C.), and also the type 6 seals 20 between the individual housing portions.

Furthermore, type 7 seals 21 exist as a transition between the refractory material of the upper nozzle 3 or the lower nozzle 7 and the housing 14 or metal sleeve 15, surrounding these on the outside. These seals prevent gas, particularly oxygen, from penetrating along at the connection place between these components into the cavity 22 between the housing portion 14*b* and the sliding gate 6. A reduced pressure is thereby ensured within the cavity 22 with respect to its surroundings during the throughflow of metal melt 2 through the bottom nozzle 1. This type 7 seal can be produced and set by the manufacturer of the nozzles.

The upper nozzle 3 can be formed of zirconium dioxide, and the lower nozzle of aluminum oxide. Foam-type aluminum oxide with low density and closed pores can also be used, likewise aluminum oxide-graphite, other refractory foamed materials or fiber materials. An oxygen getter material, for example titanium, aluminum, magnesium, yttrium or zirconium, can be arranged in the thermally insulating material of the lower nozzle 7 or between the lower nozzle 7 and the housing portion 14*a*, as a mixture with the refractory insulating material or as a separate portion.

The bottom nozzle according to the invention has a substantially smaller leakage rate than known systems. Type 1 or type 2 seals have a leakage rate of about $10^3$-$10^4$, or $10^2$-$10^3$, ml/s, and standard materials for type 3 seals lead to leakage rates of 10-100 ml/s. Type 4 seals lead to a leakage rate of negligibly less than $10^{-8}$ ml/s when metal (for example steel) is used as the material. Type 5 and type 6 seals, when polymer material is used, have a leakage rate of about $10^{-4}$ ml/s and, with the use of the corresponding graphite seals, reach a leakage rate of about 1 ml/s. Type 7 seals are similar to a combination of type 3 and type 4 seals, and can reach a leakage rate of 1-10 ml/s. The leakage rates are related to the operating state of the bottom nozzle.

The standardized leakage rate (Nml/s) is given by the following formula:

$$(\text{Nml/s})=\text{leakage rate (ml/s)}\times p_{avg}/1\ \text{atm}\times 273^\circ\ \text{K}/T_{avg}$$

where:

$p_{avg}=(p_{in}+p_{out})/2$ <atm>

$T_{avg}=(T_{in}+T_{out})/2$ <° K> avg=average value.

The standardized leakage rate according to the invention is thereby of the order of magnitude of 1-10 Nml/s, while the combination of type 1, type 2 and type 3 seals leads, in the best case, to a leakage rate of 150 Nml/s.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method for regulating metal melt throughflow through a melt throughflow aperture in a bottom nozzle of a metallurgical vessel having an upper nozzle arranged in a floor of the metallurgical vessel and a lower nozzle arranged below the upper nozzle, the method comprising introducing inert gas through at least one inert gas inlet aperture into the melt throughflow aperture in the bottom nozzle, arranging a temperature sensor on or in the lower nozzle for determining a temperature in a wall of the bottom nozzle, and regulating an inert gas supply into the bottom nozzle using measurement signals from the sensor, wherein a decrease in the temperature signals an increase of metal clogging and an increase in the temperature signals a decrease of metal clogging.

2. The method according to claim 1, wherein the regulating step comprises reducing a throughflow quantity and/or the pressure of the inert gas from an existing throughflow quantity or existing pressure until the sensor signals an increase of metal clogging, and/or increasing the throughflow quantity and/or the pressure from an existing throughflow quantity or existing pressure until the sensor signals a decrease or release of the metal clogging.

3. The method according to claim 1, wherein the temperature sensor is arranged on or in an outside wall of the lower nozzle.

4. The method according to claim 1, wherein the regulating step comprises reducing the throughflow quantity and/or the pressure until the measured temperature of the wall falls more rapidly than a predetermined threshold value of cooling, and/or increasing the throughflow quantity and/or the pressure until the measured temperature of the wall falls less rapidly than a predetermined threshold value of cooling.

5. The method according to claim 1, further comprising regulating the flow of metal melt by a valve arranged above or below the upper nozzle.

6. The method according to claim 1, wherein the step of introducing the inert gas into the melt throughflow aperture of the bottom nozzle takes place in the lower nozzle below the upper nozzle.

7. The method according to claim 1, wherein the inert gas comprises argon.

8. A bottom nozzle for a metallurgical vessel for performing the method according to claim 1, the bottom nozzle comprising an upper nozzle arranged in a floor of a metallurgical vessel and a lower nozzle arranged below the upper nozzle, at least one inert gas aperture having an inert gas connection arranged below the upper nozzle, and a temperature sensor arranged on or in an outside wall of the lower nozzle for determining temperature in a wall of the bottom nozzle, wherein the sensor is connected with a flow control for the inert gas.

9. The bottom nozzle according to claim 8, wherein at least one of the upper and lower nozzles has a heater.

10. The bottom nozzle according to claim 8, wherein a valve for regulating flow of molten metal is arranged above or below the upper nozzle.

* * * * *